US005556121A

United States Patent [19]

Pillot

[11] Patent Number: 5,556,121

[45] Date of Patent: Sep. 17, 1996

[54] MOTORIZED ASSISTANCE DEVICE ADAPTABLE ON AN ELEVATOR WHEELCHAIR AND ELEVATOR WHEELCHAIR INCORPORATING SAME

[75] Inventor: Bernard Pillot, Romans, France

[73] Assignee: International Diffusion Consommateurs I.D.C., France

[21] Appl. No.: 542,329

[22] Filed: Oct. 12, 1995

Related U.S. Application Data

[63] Continuation of Ser. No. 120,914, Sep. 15, 1993, abandoned.

[30] Foreign Application Priority Data

Sep. 15, 1992 [FR] France ..... 92 11231

[51] Int. Cl.[6] ..... A61G 5/00

[52] U.S. Cl. ..... 280/304.1; 280/250.1; 297/DIG. 4; 297/DIG. 10; 180/907

[58] Field of Search ..... 280/250.1, 304.1; 180/907; 297/DIG. 4, DIG. 10, 344.16, 344.17; 414/921

[56] References Cited

U.S. PATENT DOCUMENTS

| | | | |
|---|---|---|---|
| 3,907,051 | 9/1975 | Weant et al. | 180/907 |
| 4,519,649 | 5/1985 | Tanaka et al. | 297/DIG. 4 |
| 4,569,556 | 2/1986 | Pillot | 297/DIG. 10 |
| 4,598,944 | 7/1986 | Meyer et al. | 297/DIG. 4 |
| 4,613,151 | 9/1986 | Kielczewski | 180/907 |
| 4,623,194 | 11/1986 | Pillot | 297/316 |
| 4,809,804 | 3/1989 | Houston et al. | 180/907 |
| 4,852,939 | 8/1989 | Krauska | 297/DIG. 10 |
| 5,033,993 | 7/1991 | Genaw et al. | 280/250.1 |
| 5,096,008 | 3/1992 | Mankowski | 180/907 |
| 5,366,036 | 11/1994 | Perry | 180/907 |

FOREIGN PATENT DOCUMENTS

| | | | |
|---|---|---|---|
| 2492657 | 4/1982 | France . | |
| 2529456 | 1/1984 | France . | |
| 686790 | 3/1994 | Japan | 280/250.1 |
| 776610 | 11/1980 | U.S.S.R. | 414/921 |

*Primary Examiner*—Eric D. Culbreth
*Assistant Examiner*—Min Yu
*Attorney, Agent, or Firm*—Bacon & Thomas

[57] ABSTRACT

A motorized assistance device for use on an elevator wheelchair for handicapped persons includes a supporting cradle intended to be fitted on the chassis of the wheelchair; a motorization unit mounted on the cradle and including a mobile member, with reversible displacement, operatively connected to a transmission; at least one articulated system actuated by the transmission and including a first set of levers intended to act on articulated structure of the wheelchair, and a second set of levers actuated by the first set of levers and intended to act on a maneuvering assembly; and a unit for controlling operation of the motorization unit. The device is particularly applicable to manually controlled wheelchairs.

18 Claims, 8 Drawing Sheets

MOTORIZED ASSISTANCE DEVICE ADAPTABLE ON AN ELEVATOR WHEELCHAIR AND ELEVATOR WHEELCHAIR INCORPORATING SAME

This application is continuation of application Ser. No. 08/120,914, filed Sep. 15, 1993, now abandoned.

FIELD OF THE INVENTION

The present invention relates to chairs used by handicapped persons and invalids and more particularly to wheelchairs, whether they are foldable or not.

BACKGROUND OF THE INVENTION

It is incontestable that wheelchairs have rendered handicapped persons and invalids mobile. However, such wheelchairs present a number of drawbacks, coming from the fact that the users can occupy only a sitting position which, moreover, is generally maintained for relatively long periods of time.

In the first place, this sitting position, the only one which can be adopted, does not allow re-adaptation to normal life and does not facilitate social contacts.

In the second place, this sitting position, maintained for generally long periods of time, is responsible for a physical deterioration loading to a loss of amplitude of angular mobility of the lower limbs, poor blood circulation, a marked slowing-down of the digestive and intestinal functions, fragility of the bones, etc. . .

In an attempt to overcome these drawbacks, different propositions have been made from a concept employing, on the chassis of the chair, an articulated structure comprising a backrest, a seat and a footrest. As a general rule, such an articulated structure is mounted on the seat by a horizontal front axle perpendicular to the vertical plane of symmetry of the chassis.

One of the propositions consists in interposing between the chassis and the structure a jack with electric motor which may be controlled to provoke raising or lowering of the articulated structure.

Another proposition has been to dispose between the structure and the chassis of the chair, on the one hand, at least one elastic compensator member and, on the other hand, at least one maneuvering assembly for performing a function of control and monitoring of the relative pivoting of the articulated structure and a function of geometrical locking of said structure, in lowered or raised position with respect to the chassis.

Such a proposition is illustrated by French Patent No. 2 529 456.

The technical solution thus proposed presents advantages of lightness, simplified construction and assembly, and enables the user to act, without considerable expenditure of physical energy, on the maneuvering assemblies for controlling and monitoring the raising and lowering strokes of the articulated structure on which he/she is resting.

In the concept of such a proposition, the maneuvering assemblies are designed so as to have available, in lowered position and in raised position, two states with certain geometrical locking, thus giving two extreme stable positions ensuring total safety for the user in order to avoid either an untimely elevation under the action of the elastic compensator, or a sudden lowering from the position of elevation or verticalization.

It must certainly be considered that such a proposition gives entire satisfaction to the users by the versatility of use that it gives them and by the freedom of movement that it offers.

Studios of operation, use and functional assessment of such elevator chairs, or verticalizers, have shown that, in certain cases, the users would have wished to be able to have, temporarily, a sort of assistance for alleviating or reducing the physical action which they must bear on the maneuvering assemblies. Such is the case when the user is suffering from a passing fatigue which is natural or consecutive to an operation or whose physical force has decreased slightly since the beginning of using such a wheelchair, without losing weight, to such an extent that the adjustment of the elastic compensator or replacement thereof become inoperative.

The problem is then raised of having available a partial and temporary motorized assistance, adaptable on a manually controlled elevator wheelchair or verticalizer or the above type, without converting such a wheelchair into complete-assistance equipment, such as those of the first proposition set forth hereinabove.

It may be considered that such a need may be satisfied by providing a motorization installation acting directly on the lateral control assemblies. However, experiments carried out in this sense show that such a modus operandi is virtually impossible and loads to ruptures either of the lateral assemblies directly or of their articulation members due to the high forces which must be applied to combat the multiplier effect which is attached by construction to the lateral assemblies.

It may also be considered that it suffices to act in association with the elastic compensator on the articulated structure and more particularly on the foundation, for example, by means of an articulated rod controlled by an appropriate driving member, In fact, such a proposition is not realistic either, as it does not take into account the necessity of neutralizing the upper and lower locking positions before initiating any control of pivoting of the articulated structure in raising movement or in lowering movement.

An additional difficulty to be solved concerns the desire to maintain in the wheelchair or verticalizer its nature of manual control and to provide possible means of motorized assistance which are adaptable, in removable manner, rapidly and easily, without their positioning disturbing the usual operational characteristics, and those of rolling stability, when stationery in lowered or raised position.

It is an object of the invention to respond to the demand thus perceived, by proposing technical means which overcome the problems set forth hereinabove, offering a practical, inexpensive, easily adaptable and dismountable solution, to render an elevator wheelchair or verticalizer possibly provided, or not, with a motorized assistance device.

SUMMARY OF THE INVENTION

To attain the above objects, the invention proposes a motorized assistance device, adaptable on an elevator wheelchair which comprises a chassis supporting an articulated structure connected to said chassis by at least one manual manoeuvring assembly, device characterized in that it comprises:

a bearing cradle intended to be fitted on the chassis, a motorization unit mounted on the cradle and comprising a mobile member, with reversible displacement, connected to a transmission borne by the cradle, at least one articulated system attacked by the transmission and comprising a first set of livers intended to act on the articulated structure, and a second set of levers actuated by the first and intended to act on the maneuvering assembly, and a box for controlling operation of the motorization unit, The invention also has for its object an elevator wheelchair, of the type comprising a chassis supporting an articulated structure formed by a backrest, a seat and a footrest, articulated in line with one another, said wheelchair comprising at least one elastic member interposed between the articulated structure and the chassis, and at least one maneuvering assembly which is interposed between the structure and the chassis on which it is articulated and which presents a manual control member, said wheelchair being characterized in that it comprises a motorized assistance device comprising:

a cradle fitted on the chassis, a motorization unit mounted on the cradle and comprising a mobile member, with reversible displacement, connected to a transmission borne by the cradle, at least one articulated system attacked by the transmission and comprising a first set of levers connected to the transmission, and a second set of levers connected to the first and mounted articulated on the seat and on the manual control member, and a box for controlling the motorization unit, placed at the user's disposal.

BRIEF DESCRIPTION OF THE DRAWINGS

The invention will be more readily understood on reading the following description with reference to the accompanying drawings, in which.

DETAILED DESCRIPTION OF THE DRAWINGS

Figure 1:
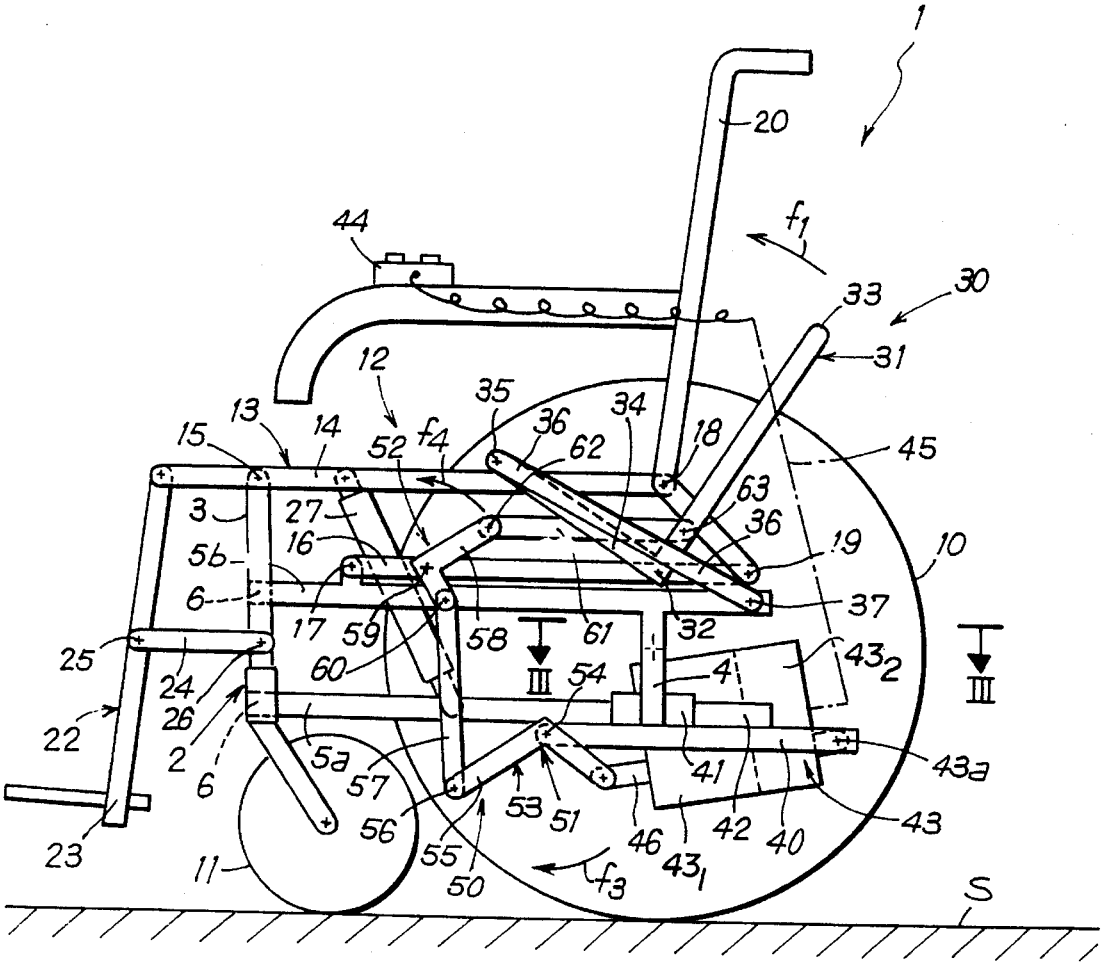
FIG. 1 is a side elevation schematically showing a wheelchair for handicapped person or invalid, equipped with a device according to the invention.
Figure 2:
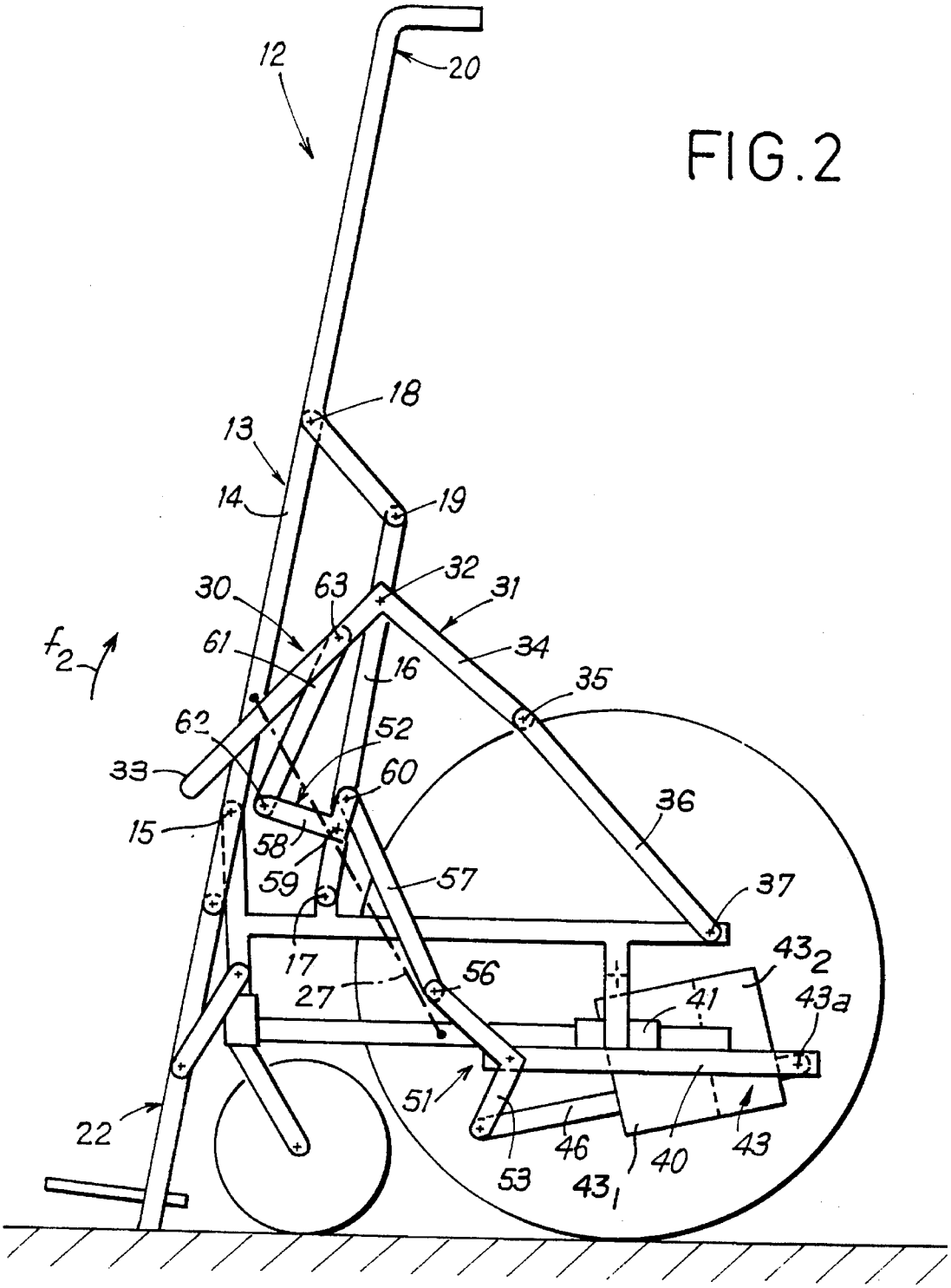
FIG. 2 is a side view similar to FIG. 1 but illustrating the subject matter of the invention in another characteristic position.
Figure 3:
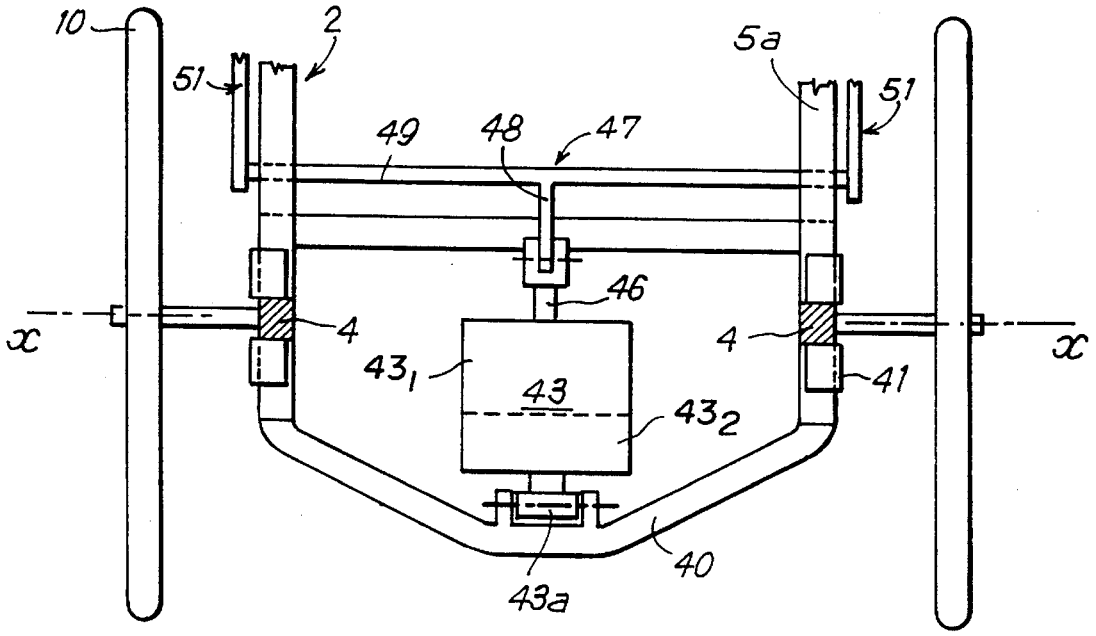
FIG. 3 is a partial section taken substantially along line III—III of FIG. 1.

Referring now to the drawings, FIGS. 1 to 3 schematically show a wheelchair 1 comprising a chassis 2 constituted by front (3) and rear (4) uprights joined together by longitudinal elements 5*a* and 5*b*, for example, and by crosspieces such as 6. The chassis 2 is conventionally provided with bearing and driving wheels 10 and with swivelling wheels 11.

The chassis 2 may equally well be rigid or possibly foldable and, in such a case, the crosspieces 6 are designed from articulated elements lockable in opened-out position, in known manner, this not forming part of the present invention.

The chassis 2 is equipped with an elevator device made in the form of an articulated structure, generally designated by reference 12. The articulated structure 12 comprises a seat 13 which is for example constituted by two upper longitudinal elements 14 articulated by two front pins 15 on extensions of the front uprights 3. The seat 13 is also composed of two secondary longitudinal elements 16 which are mounted via pivot pins 17 on the upper longitudinal elements 5*b* and standing back with respect to front uprights 3.

The rear ends of the longitudinal elements 14 and 16 are joined by pivot pins 18 and 19 to a frame 20 or the like constituting a backrest element. The upper longitudinal elements 14 are provided, beyond the pivot pins 15, with extensions 21 on which is articulated a footrest 22 constituted by legs 23 connected to the front uprights 3 by spacer bars 24 which are each articulated by a pin 25 on the leg and a by a pin 26 on the front upright 3.

The articulated structure 12 is joined to chassis 5 by at least one elastic member 27 interposed between the seat 13 and the chassis 5. The elastic member 27 is preferably disposed between the upper longitudinal elements 14 of the seat 13 and the lower longitudinal elements 5*a* of the chassis 2. The elastic member 27 is designed to perform a function of compensation of weight and of absorption of energy, as well as a function of restitution, and may be formed by a compensating spring or, or preferably, by a jack of the gas driven type.

The articulated structure 12 is in addition joined to chassis 5 by two lateral maneuvering assemblies 30 intended to perform a function of manual control and monitoring of relative pivoting of the structure 12 with respect to the chassis and a function of stop and locking in a position of maximum lowering as illustrated in FIG. 1 and in a position of maximum elevation as shown in FIG. 2.

To that end, each maneuvering assembly 30 comprises a lever 31 mounted articulated by a pin 32 on the seat element 13 and, more particularly, the lower longitudinal element 16 near the point of articulation 19. The lever 31 forms a first arm 33 constituting a manual control member and a second arm 34 which is joined by a pivot pin 35 to a connecting rod 36 mounted by a pivot pin 37 on the rear part of the upper longitudinal element 5*b* of the chassis 2.

The relative lengths between the arm 34 and the connecting rod 36 as well as the positions of the pivot points 32 and 37, are chosen so that, in the lowered state according to FIG. 1, the pivot point 32 is disposed below the fictitious line passing through pivot points 35 and 37. This results in a geometrical locking opposing any untimely pivoting of the lever 31 in the direction of arrow $f_1$.

The characteristics given hereinabove are also provided so that, in the state of elevation, as illustrated in FIG. 2, the pivot point 35 is placed below the fictitious line passing through pivot points 32 and 37. This also results in this state in a geometrical locking opposing any untimely displacement of the lever 31 in the direction of arrow $f_2$.

The verticalizer wheelchair described hereinabove may therefore occupy a lowered position as illustrated in FIG. 1, offering a stable sitting position. In this state, the compensator member or members 27 are compressed.

When the invalid wishes to be transferred from the sitting position to a verticalized position, he/she acts on he levers 31 and more particularly arms 33 in the direction of arrow $f_1$, so as to provoke displacement of pivot points 32 and above the connecting rods 36, to break the geometrical locking and thus release the displacement of the articulated structure 12. Levers 31 may, in that case, with the aid of the elastic compensator member or members 27, give the user control of the elevation of the structure 12 until the stable state of FIG. 2 is attained, in which the footrest 22 abuts on the ground S, whilst the pin 35 has passed above the fictitious line joining the pivot points 32 and 37.

In this state, a geometrical locking is established, giving stability and security in the elevated position.

The object of the invention is to propose a device which takes into account the above structural and functional characteristics, and which makes it possible, when this proves necessary, to fit a motorized assistance device whose temporary function is to take over control from the invalid who, momentarily, does not have the physical capacity to act on the maneuvering assemblies 30.

FIGS. 1 and 3 show that the motorized assistance device, adapted to be fitted on an elevator wheelchair of the above type, comprises a rigid cradle 40, for example, made in the form of a frame which may be fitted by fixation members 41 on the chassis 2 and more particularly the longitudinal members 5*a*, According to an advantageous arrangement of the invention, the cradle 40 is designed to be fitted in the rear part of the chassis 2 and beneath the axis of rotation or axle x-x', corresponding to the rear wheels 10, so as to contribute to a lowering of the centre of gravity to give, in all the positions of the wheelchair, an appreciable, noteworthy stability and security. The cradle 40 is preferably designed to be fitted on rear extensions 42 of the longitudinal members 5*a* and, for example, to be immobilized in translation by the members 41 which may be associated with any removable fixation means by tightening knob or the like.

FIGS. 1 and 3 show that it may be advantageous to make the members 41 in the form of bent tabs or the like capable of tightening around the lower longitudinal members 5*a*, particularly on either side of the rear uprights 4.

In any case, the cradle 40 is designed to be removably fitted, to allow rapid assembly and dismantling.

The cradle 40 bears a motorization unit 43 advantageously comprising a reversible electric motor 43, and a rechargeable accumulator battery $43_2$. Such a motorization unit 43 is available on the market.

The motorization unit 43 is provided with a box 44 for remote control, for example by means of a cord 45. Box 44 is placed at the user's disposal, being, for example, removably fitted on one of the elements of the articulated structure 12 and, for example, an armrest.

The motorization unit 43, mounted on the cradle 40 via an articulation 43*a*, comprises a mobile control member 46 which is, for example, similar to the rod of a jack, oriented to attack a transmission 47 which is preferably designed to introduce a transformation of the reciprocating rectilinear displacement of the rod 46. The transmission 47 comprises, for example, a crank 48 borne by a shaft 49 mounted to rotate in bearings borne by the cradle 40.

The transmission 47 is designed to control, simultaneously an in synchronism, two lateral articulated systems 50 each composed of two sets of levers 51 and 52. The first set of levers 51 comprises a bent lever 53 mounted via a pivot point 54 to rotate on the cradle 40. Axis of rotation 54 may merge with the shaft 49 and, in such a case, crank 48 is assimilable to one of the arms of each of the bent levers 53. It must be considered that a different arrangement may also intervene, consisting, for example, in joining the rod 46 of the motorization unit 43 with the shaft 49 which would ensure a physical join between the corresponding arms of the two lateral levers 53.

In all possible cases of construction, the bent levers 51 comprise angularly fast arms so that the second arm, designated by reference 55, is joined by a pivot point 56 to a connecting rod 57, itself connected to the second set of levers 52.

FIG. 2 demonstrates more precisely that the second set 52 comprises a bent lever 58 which is mounted via a pivot point 59 on the longitudinal member 16. Lever 58 is articulated by its small arm on the connecting rod 57 via an articulation 60 and by its large arm to a connecting rod 61 by means of an articulation 62. The connecting rod 61 is joined by an articulation 63 to the manual control member 30, so that the articulation 63 is disposed between the pivot point 32 and the end of the arm 33.

The motorized assistance device in association with a wheelchair of the type described hereinabove functions as follows, from the position corresponding to a stable lowered state of the articulated structure 12.

Figure 4:
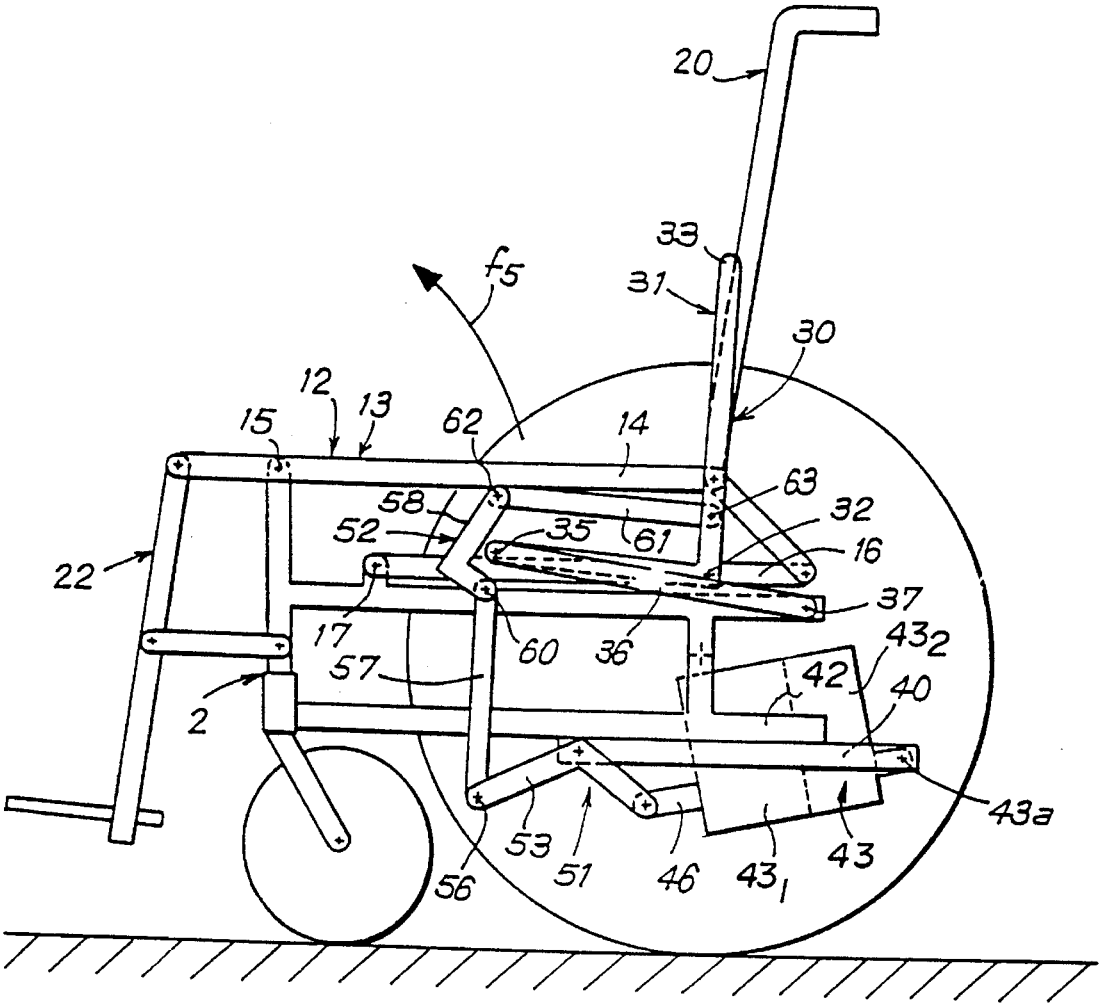
FIGS. 4, 5 and 6 are side elevations illustrating three characteristic operational positions of the subject matter of the invention.
Figure 5:
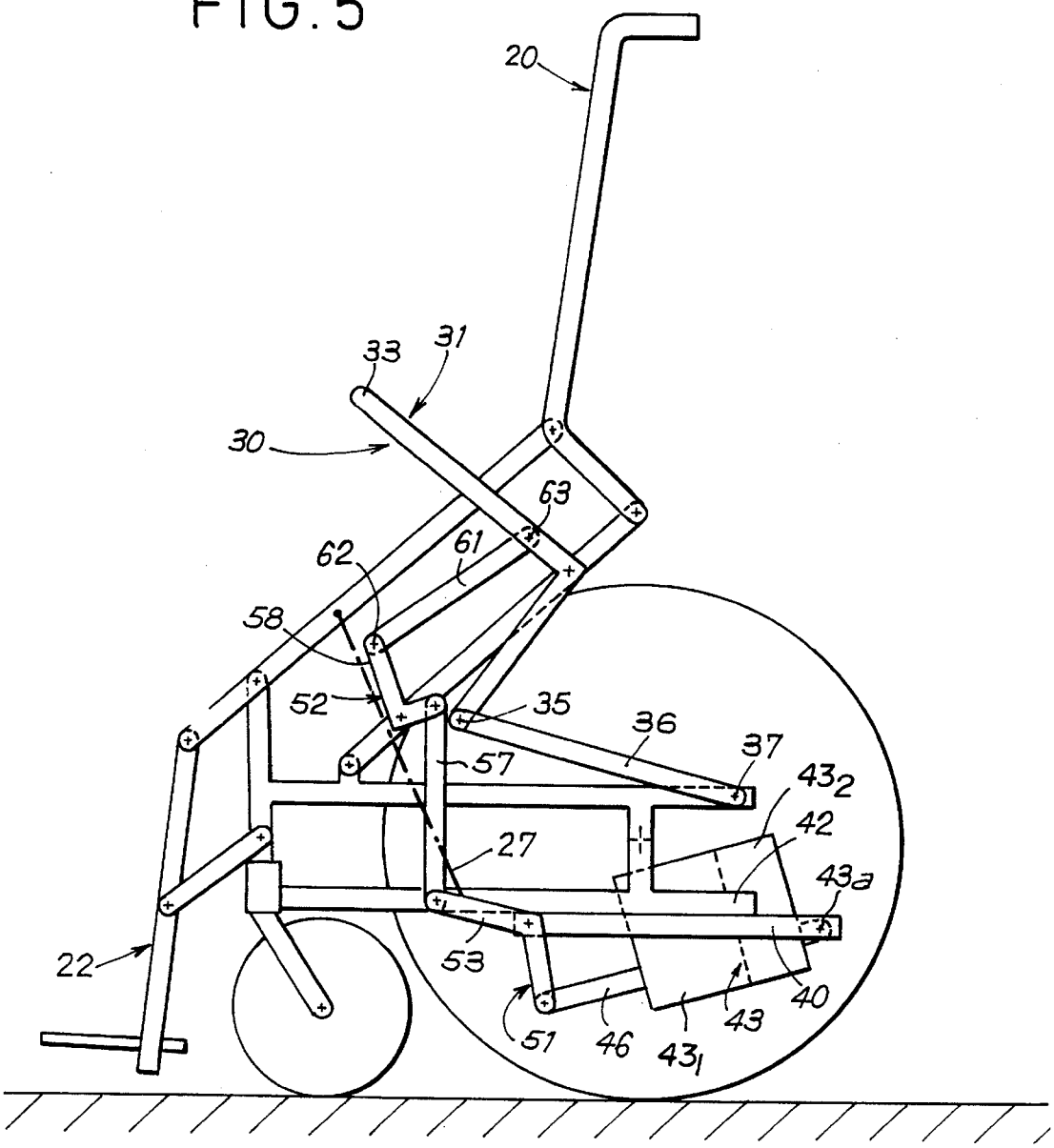

When the user wishes to pass into verticalized position, he/she presses on the appropriate control member of the box 44 to ensure supply of the motorization unit 43 in the direction for which the rod 46 effects its extension stroke. The lever or levers 53 of the first sets 51 then pivot in the direction of arrow $f_3$ and push the connecting rods 57 which cause the levers 58 of sets 52 to pivot in the direction of arrow $f_4$. By reason of the geometrical locking established, the action of the connecting rods 57 has no immediate incidence on the pivoting of the articulated structure 12 on the pivot points 15 and causes only the bent levers 58 to pivot which, by their large arm, act in traction on the connecting rods 61. The control members 30 are obliged to pivot in the direction of arrow $f_1$, so that the pivot points 35 lower and cause the connecting rods 36 to pass in the position illustrated in FIG. 4, in which the pivot points 32 are placed relatively above these connecting rods, thus releasing the geometrical locking previously established. In this position, the action of thrust of the connecting rods 57, whilst producing pivoting of the levers 58, ensures elevation of the seat 13 in the direction of arrow $f_5$ in association with the restitution of work stored by the elastic member or members 27. The articulated structure 12 is thus progressively brought into an intermediate position of elevation as illustrated in FIG. 5.

Figure 6:
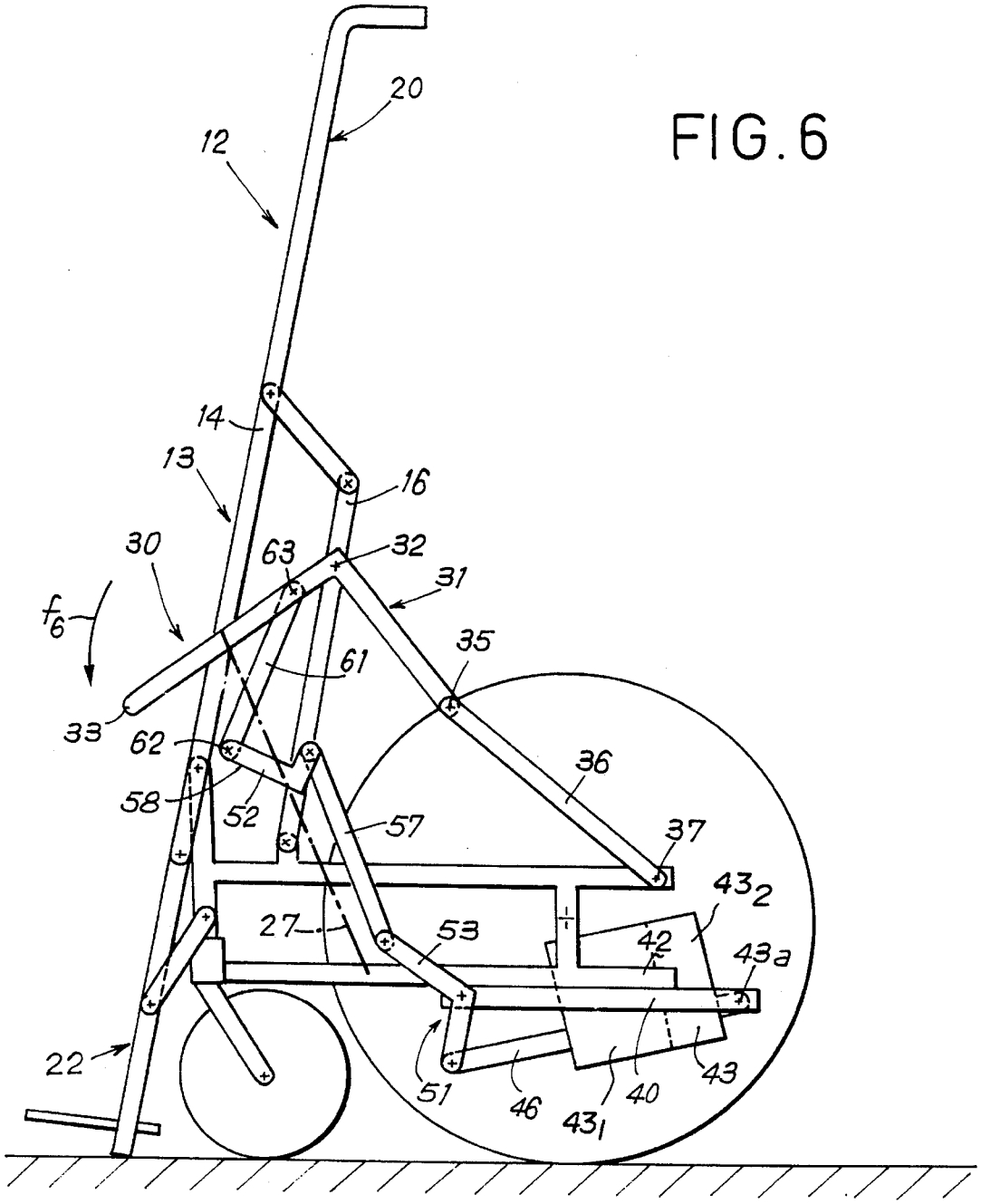

At the end of elevation illustrated by FIG. 6, the action of the rod 46 is faced with the impossibility of additional development of the articulated structure 12 brought to abut on the ground S via the footrest 22.

In this state, the connecting rods 57 act solely to rotate the bent levers 58 of the two sets 52, so as to force rotation of the levers 31 in the direction of arrow $f_6$ (FIG. 6) to pass the pivot pin 35 beyond the fictitious line passing through the pivot points 32 and 37, as illustrated in FIG. 2. In this position, the geometrical locking has intervened to stabilize the articulated structure 12 in a verticalized state which is safe for the user.

When the stroke for lowering eh articulated structure is to be controlled, the invalid acts on the box 44 to control the reverse supply of the motorization unit 43 in order to urge rod 46 in retraction stroke.

Such a displacement of the rod 46 firstly produces unlocking of the verticalized position by displacement of the articulation 35 this side of the fictitious line joining the pivot points 32 and 37.

From this state illustrated in FIG. 6, drive of the maneuvering assemblies 30 is effected concomitantly with the lowering of the seat be pivoting on the front pins 15, returning the articulated structure 12 in the intermediate position according to FIG. 5, in order then to attain, in accordance with an operational principle opposite what was described previously, the state of lowering according to FIG. 4, then, finally, the stable state locked in lowered position as illustrated in FIG. 1.

In the foregoing, it is indicated that the device according to the invention is provided to furnish, when necessary, a motorized assistance to a manually controlled verticalizer or elevator wheelchair. A removable, rapid, simple and efficient fitting of the device on the chassis 2 is therefore particularly provided. To that end, the articulated systems 50 are preferably made so that it is possible easily to break the link between the two sets 51 and 52.

Figure 7:
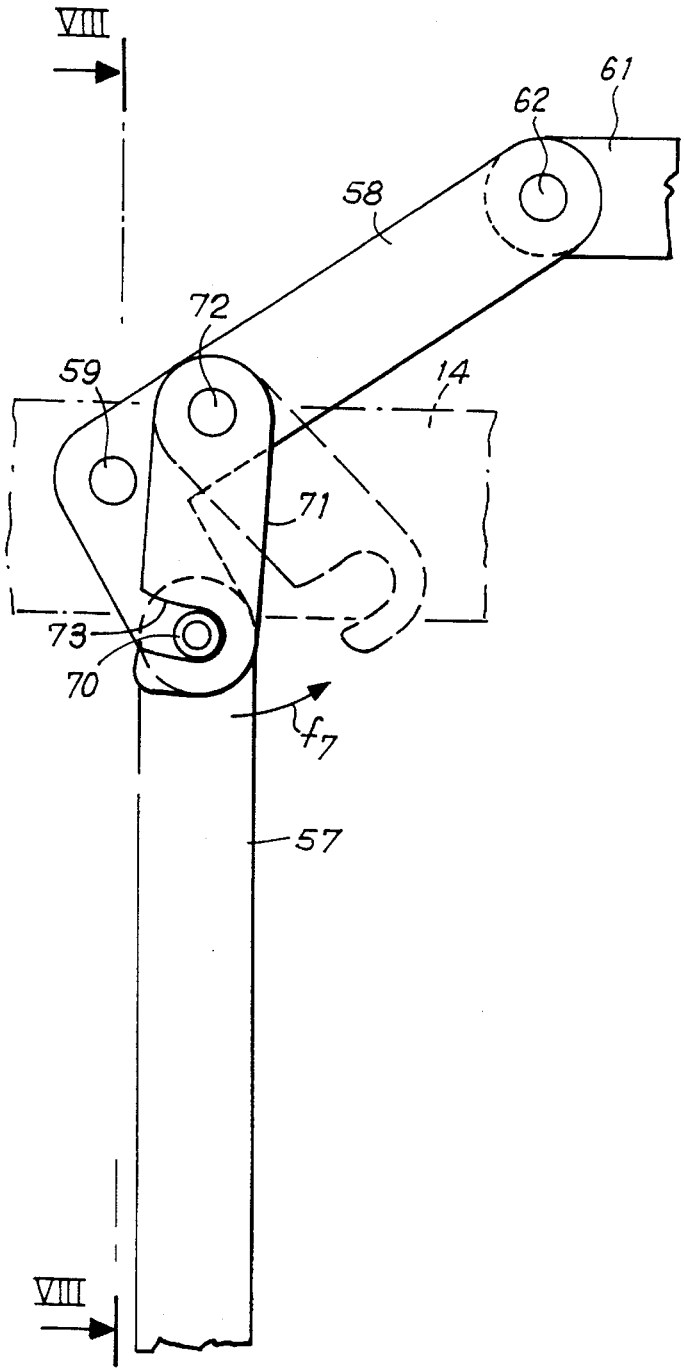
FIG. 7 is a partial elevation showing, on a larger scale, a variant embodiment of one of the constituent elements of the object of the invention.
Figure 8:
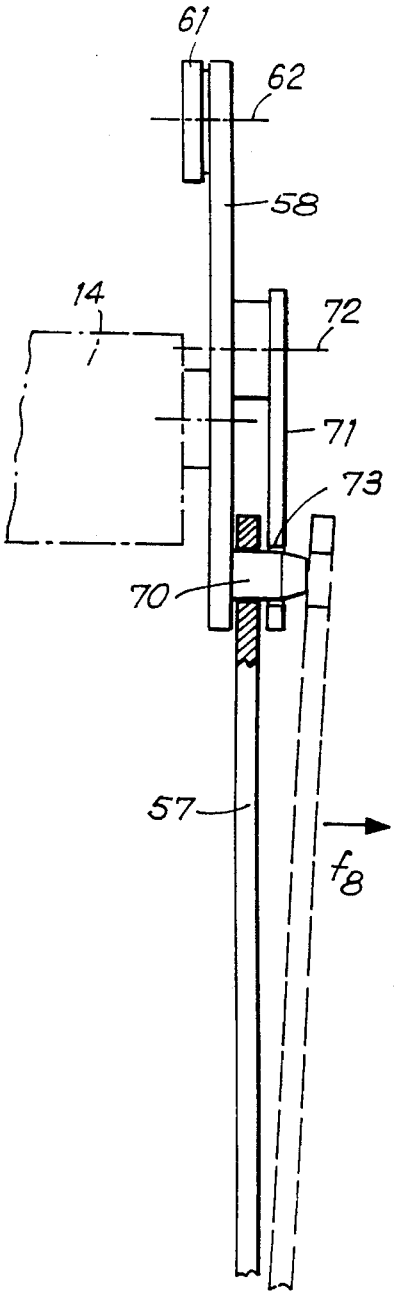
FIG. 8 is a side view, with parts torn away, taken along line VIII—VIII of FIG. 7.

FIGS. 7 and 8 show such an embodiment, consisting in providing on the small arm of each bent lever 58 a journal 70 for engagement of the corresponding end of the connecting rod 57. Immobilization of the connecting rod 57 on the journal is for example ensured by a tab 71 mounted mobile on a pin 72 of the lever 58 and comprising at its opposite end a notch 73 intended to overlap the journal 70 after positioning of the connecting rod 57.

In this way, after controlled free rotation in the direction of arrow $f_7$ of the tab 71, it becomes possible, by flexion in the direction of arrow $f_8$, to disengage the connecting rod 57, leaving on the articulated structure the two sets 52 constituting the systems 50. The whole of the device may then be extracted from the chassis 2 by dismantling the cradle 40 taking with it the motorization unit 43, the transmission 57, the or the two set(s) of levers 51 and the connecting rods 57.

Figure 9:
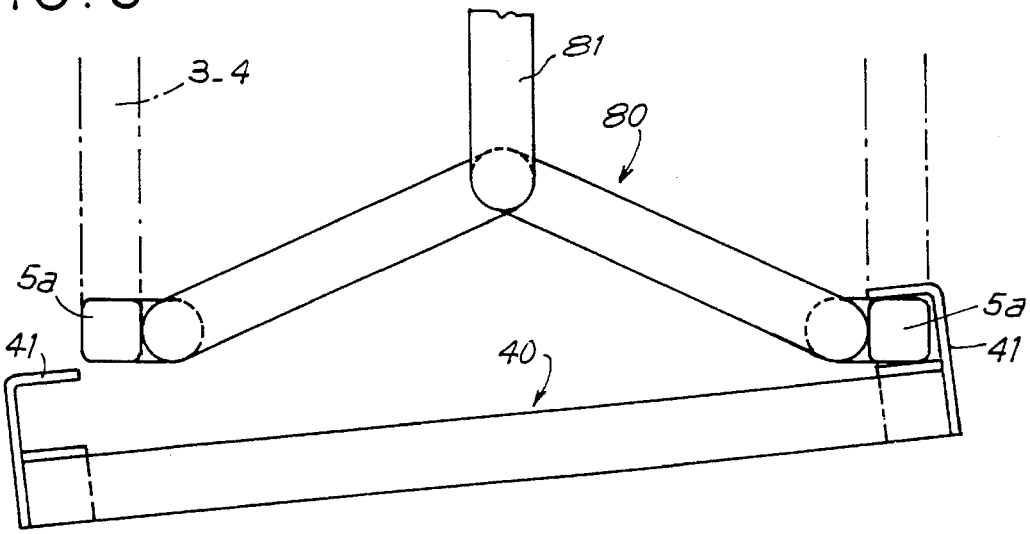
FIGS. 9 to 11 are three schematic transverse views illustrating another characteristic of the object of the invention.
Figure 10:
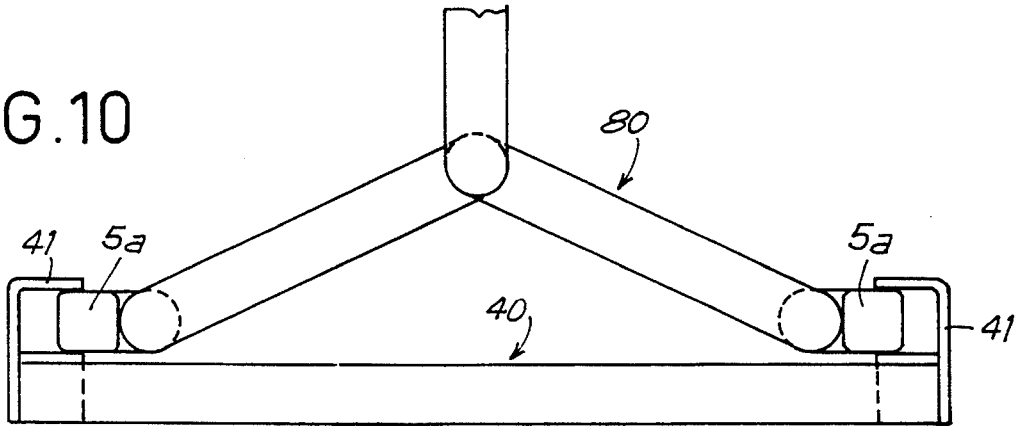
Figure 11:
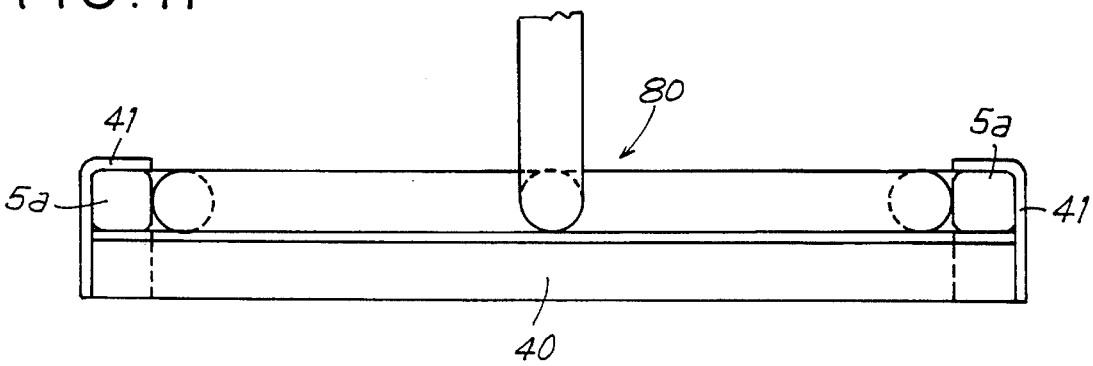

FIGS. 9 to 11 show a possibility of rapid fit of the cradle 40 on the chassis 2 more particularly when the latter is in foldable form, as is frequently the case in wheelchairs. In such a case, the longitudinal members **5*a*, joined by uprights 3 and 4, are also joined by one or more sets of scissor elements 80 associated with one or more coupling bars 81. In that case, when the chassis 2 is in a partially folded position, as illustrated in FIG. 9, the cradle 40 is positioned so that the transverse distance between the longitudinal members 5*a* is loss than the fixed distance between the members 41 which may advantageously be constituted, as stated hereinabove, by bent tabs or the like. In this way, it is possible easily to dispose the cradle 40 in the plane of the longitudinal elements 5*a*, to ensure its lateral engagement on one of these latter and to control by manual action, particularly on the coupling bars 81, a transverse opening of the chassis leading to the simultaneous engagement of the two longitudinal elements 5*a* in the members 41**.

The invention is not limited to the embodiments described and shown, as various modifications may be made thereto without departing from the scope thereof.

What is claimed is:

1. A motorized assistance device, adaptable on an elevator wheelchair including a chassis supporting an articulated structure connected to said chassis by at least one manual maneuvering assembly, said device comprising:

a supporting cradle intended to be attached to the chassis by fixation members, a motorization unit mounted on the cradle and including a mobile member, with reversible displacement, operatively connected to a transmission, said motorization unit being of the reversible electrical type and is pivotally mounted to a rear portion of the cradle, at least one articulated system actuated by the transmission and including a first set of levers intended to act on the articulated structure, and a second set of levers actuated by the first set of levers for acting on the maneuvering assembly, and means for controlling operation of the motorization unit.

2. The device of claim 1, wherein two lateral articulated systems are provided, said transmission being operatively coupled to each of said articulated systems.

3. The device of claim 2, wherein the transmission is operatively connected to the mobile member to alter a displacement of the mobile member in order to actuate the two lateral articulated systems.

4. The device of claim 1, wherein the first set of levers is connected to the second set by means permitting rapid dismantling between said first set of levers and second set of levers.

5. The device of claim 1, further comprising means for removabling fixing the cradle on the chassis.

6. A motorized assistance device, adaptable on an elevator wheelchair including a chassis supporting an articulated structure connected to said chassis by at least one manual maneuvering assembly, said device comprising:

a supporting cradle intended to be attached to the chassis by fixation members a motorization unit mounted on the cradle and including a mobile member, with reversible displacement, operatively connected to a transmission, at least one articulated system actuated by the transmission and including a first set of levers intended to act on the articulated structure, and a second set of levers actuated by the first set of levers for acting on the maneuvering assembly, each articulated system incorporating a first set of levers including a bent lever mounted to pivot on the cradle, said bent lever having two arms, said bent lever being connected by one of said two arms to the transmission, and by the other of said two arms to a connecting rod which is mounted to pivot on the second set of levers, and means for controlling operation of the motorization unit.

7. The device of claim 6, wherein each articulated system comprises a second set of levers including a bent lever articulated on the structure, said bent lever including two arms, said bent lever being connected by one of the two arms to the connecting rod and by the other of the two arms to a small rod mounted to articulate on a respective maneuvering assembly.

8. The device of claim 7, wherein the small rod is mounted to articulate on the maneuvering assembly located between a pivot location of the maneuvering assembly on the articulated structure and a manual actuation member.

9. An elevator wheelchair for a handicapped person or invalid comprising a chassis supporting an articulated structure formed by a backrest, a seat and a footrest, articulated in line with one another, said wheelchair comprising at least one elastic member interposed between the articulated structure and the chassis, and at least one maneuvering assembly which is interposed between the articulated structure and the chassis on which the maneuvering assembly is articulated and which presents a manual control member, said elevator wheelchair including a motorized assistance device comprising:

a cradle fitted on the chassis, a motorization unit mounted on the cradle and including a mobile member, with reversible displacement, connected to a transmission, at least one articulated system actuated by the transmission and including a first set of levers connected to the transmission, and a second set of levers connected to the first set of levers and pivotally connected to the seat and the manual control member, said first set of levers including a bent lever articulated on the cradle and connected to the transmission and a connecting rod articulated on the bent lever, and a second set of levers including a bent lever articulated on the seat and being interconnected to the connecting rod and to a small rod articulated on the maneuvering assembly, and means for controlling the motorization unit placed at the user's disposal.

10. The elevator wheelchair of claim 9, wherein the motorized assistance device includes two lateral articulated systems.

11. The elevator wheelchair of claim 9, wherein each articulated system comprises a small rod which is mounted on the maneuvering assembly by an articulation located between a point of pivoting of the maneuvering assembly on the seat and a manual control member of said maneuvering assembly.

12. The elevator wheelchair of claim 10, wherein each articulated system comprises a rapidly dismantled connection between the connecting rod and the bent lever of the second set of levers, and wherein the cradle is removably fitted on the chassis.

13. An elevator wheelchair for a handicapped person or invalid comprising a chassis supporting an articulated structure formed by a backrest, a seat and a footrest, articulated in line with one another, said wheelchair comprising at least one elastic member interposed between the articulated structure and the chassis, and at least one maneuvering assembly which is interposed between the articulated structure and the chassis on which the maneuvering assembly is articulated and which presents a manual control member, said elevator wheelchair including a motorized assistance device comprising:

a cradle fitted to a lower rear part of the chassis and below the level of the axis of rotation of rear wheels of the wheelchair, a motorization unit mounted on the cradle and including a mobile member, with reversible displacement, connected to a transmission, at least one articulated system actuated by the transmission and including a first set of levers connected to the transmission, and a second set of levers connected to the first set of levers and pivotally connected to the seat and the manual control member, and means for controlling the motorization unit placed at the user's disposal.

14. A elevator wheelchair comprising:

a chassis;

a plurality of wheels, connected to said chassis, for supporting said wheelchair;

an articulated structure, including at least a backrest and a seat, pivotally connected to said chassis for movement between a lowered position whereat said seat is arranged in a substantially horizontal plane and said backrest is located in a first substantially vertical plane, and a raised position whereat said seat and said backrest are arranged in a second substantially vertical plane;

at least one articulated system including a first set of levers and a second set of levers, said first set of levers including a manual actuation arm having a free end and being pivotally interconnected between said chassis and said articulated structure such that manual shifting of said manual actuation arm by applying force to said free end causes movement of said articulated structure between said lowered and raised positions through said first set of levers, a first lever of said second set of levers being pivotally connected to one of said first set of levers;

a motorization unit supported by said chassis, said motorization unit including a mobile member having reversible displacement, said mobile member being operatively coupled to a second lever of said second set of levers and said second lever of said second set of levers being interconnected to said first lever of said second set of levers such that actuation of said motorization unit automatically drives said articulated structure between said lowered and raised positions through said second and first set of levers; and means for controlling actuation of said motorization unit.

15. The elevator wheelchair of claim 14, further comprising a cradle fitted on the chassis, said motorization unit being of the reversible electrical type and being pivotally mounted to a rear portion of the cradle.

16. The elevator wheelchair of claim 15, wherein said first set of levers includes a bent lever articulated on the cradle and connected to the transmission and a connecting rod articulated on the bent lever, and said second set of levers includes a bent lever articulated on the seat and being interconnected to the connecting rod and to a small rod articulated on the maneuvering assembly.

17. The elevator wheelchair of claim 14, wherein the first set of levers is connected to the second set of levers by means permitting rapid dismantling between said first set of levers and said second set of levers.

18. The elevator wheelchair of claim 14, wherein two lateral articulated systems are provided.

* * * * *